US005555455A

United States Patent [19]

McGinley

[11] Patent Number: 5,555,455

[45] Date of Patent: Sep. 10, 1996

[54] RECESSED FIRE DETECTOR

[76] Inventor: Dan McGinley, 312 S. Charlotte, Bremerton, Wash. 98312

[21] Appl. No.: 318,902

[22] Filed: Oct. 5, 1994

[51] Int. Cl.[6] ..... G08B 21/00

[52] U.S. Cl. ..... 340/627; 340/628; 340/693; 340/577; 340/584

[58] Field of Search ..... 340/627, 628, 340/629, 630; 693, 632, 631, 577, 684; 52/27, 39; 248/906, 620; 362/364, 365, 366, 368

[56] References Cited

U.S. PATENT DOCUMENTS 3,892,930 7/1975 Wieder ..... 340/692
4,150,373 4/1979 Ried, Jr. ..... 340/629
4,887,073 12/1989 Nakao et al. ..... 340/693
5,333,418 8/1994 Chambers ..... 52/39
5,403,198 4/1995 Kaganemara et al. ..... 439/333

*Primary Examiner*—John K. Peng
*Assistant Examiner*—Benjamin C. Lee
*Attorney, Agent, or Firm*—Don R. Mollick

[57] ABSTRACT

The application describes a method and apparatus for detecting fire. The apparatus includes a fire detector and a mounting means adapted for attachment to both existing structures and new construction in such a manner as to not protrude into the interior spaces of structures. The method includes the steps of providing a fire detector and recessing the detector into the walls of the structure providing power to the detector and monitoring the detector.

11 Claims, 4 Drawing Sheets

RECESSED FIRE DETECTOR

FIELD OF INVENTION

This invention pertains to Fire Detection and Prevention Equipment, particularly, this invention pertains to devices for detection of fire by sensing smoke or heat in buildings and methods for recessing such detectors in walls and ceilings.

BACKGROUND OF THE INVENTION

There are many types of fire detectors in current use. For the purposes of this application fire detector is defined as a device which senses a fire in a structure by sensing heat, combustion gases or particulate matter in the atmosphere upon such detection the detector produces a signal such as a audible and/or visual alarm. In some circumstances such a detector may also activate other equipment to extinguish the fire detected such as sprinklers or extinguishers. Common names of such equipment include smoke Detector, fire alarm, thermal sensor, ionization detector, carbon monoxide detector, photoelectric detector, activator and the like.

Fire detectors are most commonly attached to inner surfaces of buildings such as walls and ceilings. Since smoke and hot air rise the devices are preferably matched to the ceiling. The first generation of such devices were wired into the buildings power supply in a nonintrerruptable connection. The second generation of such devices were battery powered and removable attached to the surface to allow changing of the battery. Many present building codes require that the devices have dual power sources such as the hard wired connection and a battery for emergency power. In addition, several detectors per floor are required.

In modern construction it is generally preferable from an esthetic viewpoint that internal building surfaces be free of obstructions and protrusions. To accomplish this goal recessed fixtures have been developed both for new construction and retrofitting. Such fixtures include recessed and indirect lighting appliances and recessed speakers.

A major disadvantage of present detectors is their visual appearance. Since they are attached to the interior surface they protrude from that surface. The protrusion from the surface breaks homogeneity of that surface and makes the detector all that more apparent when other fixtures are recessed. Accordingly, there is a long-standing need for a recessed fire detector.

SUMMARY OF THE INVENTION

The invention provides an effective inexpensive method and apparatus for recessing a fire detector. The invention allows use of dual power supplies. The invention allows easy replacement of batteries and servicing. The fire detection ability of the detector is not compromised by the use of this invention. The invention maintains the insulation capabilities of the structure. The invention is equally adaptable to both original construction and remodeling use.

The apparatus of the invention includes a modern dual power fire detector. Other equivalent detectors could be substituted if desired. A mounting arrangement is provided to mount the detector in the interior of a surface. The detector is removable attached to the mounting arrangement to allow servicing and battery replacement. The mounting can be varied to allow mounting the detector in a ceiling or other flat surface. The mounting arrangement is simple yet strong to allow positioning between different spacing of support members.

The method of the invention includes mounting a detector to the ceiling of a structure with a releasable attachment means. Recessing the detector in the mounting. Powering the detector with detachable supply leads.

DETAILED DESCRIPTION OF THE FIGURES

Figure 1:
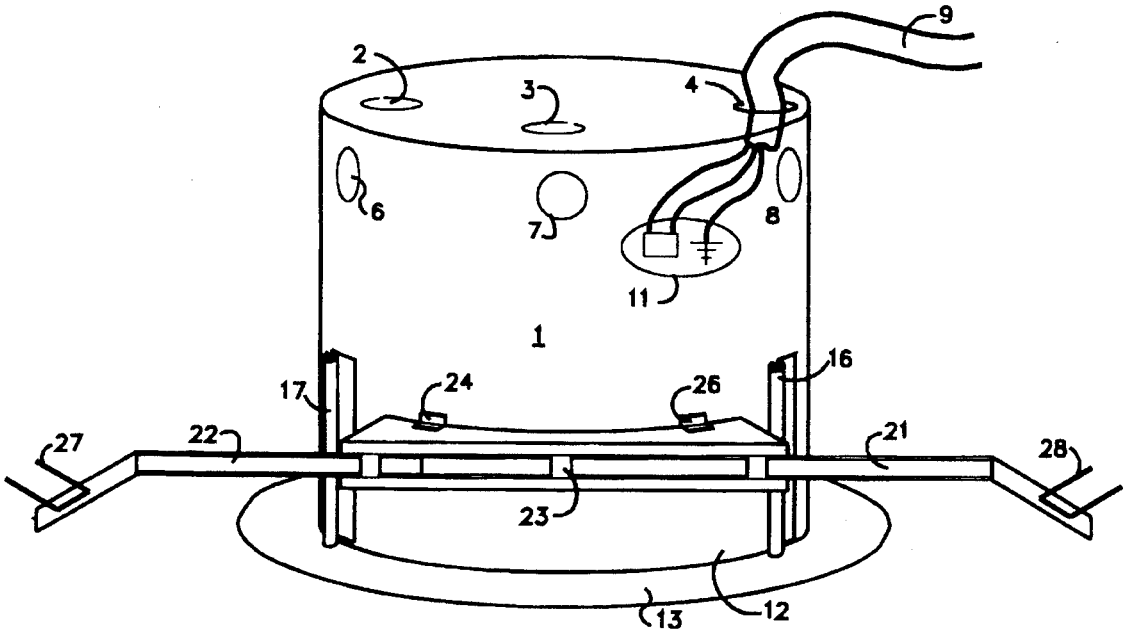
FIG. 1 is a front perspective view of the housing of the invention.

FIG. 1 is a front perspective view of the housing of the invention. All components are attached to a recessed canister 1. Recessed canister 1 is a cylinder with one closed end preferably constructed of a metallic material such as tin or zinc coated steel, aluminum, copper or equivalent material. Canister 1 provides attachment points for the fire detector unit and the structure of the building. Canister 1 also provides a clean concealed area to protect the fire detector from debris and dust. Finally canister 1 provides means for attachment and concealment of power supply wiring. Canister 1 provides a plurality of "knock out" wire through holes 2–8 "knock out" holes 2–8 are are attached by a small tang allowing easy detachment. Three such holes 2–4 are on the top of canister 1 and three other holes 6–8 are visible on the side of canister 1. A 110 volt supply line 9 is shown entering through hole 4 a female quick connector end 11 is attached to the end of line 9 ending in canister 1. Attachment of supply line 9 to quick connector 1 1 is preferably by wire nuts or equivalent. The other end 12 of canister 1 includes a flange 13. A plurality of screw retainer tab stops 16, 17 are attached to the outer surface of canister 1 adjacent to flange 13 by means of spot tack welds. A plurality of support hangers 21,22 are slidably attached to a support hanger support 23 and provided with connection means 27, 28 such as a nail or staple. Support hanger support 23 is in turn attached to canister 1 by means of a plurality of attachment tabs 24, 26. Attachment tabs 24, 26 are attached to canister 1 by means of spot welds and constructed of the same material as canister 1. Support hangers 21,22 and support hanger 23 support are all made of the same material as canister 1.

Figure 1A:
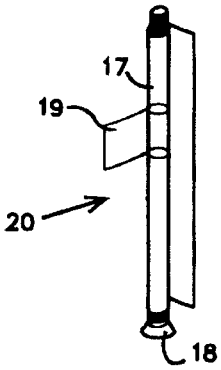
FIG. 1A is a front perspective view of a portion of FIG. 1.

FIG. 1A is a front perspective view of a portion of FIG. 1 detailing the components of screw retainer assembly 20. Screw retainer tab assembly 20 is used only for remodel applications. Screw retainer tab stop 17 accepts a self tapping screw 18 and a remodel retainer tab 19. These three components form the screw retainer tab assembly 20. Remodel retainer tab 19 is made of the same material as canister 1. Remodel retainer tab 19 is formed to accommodate screw 18 and is so arranged as to rotate outward from canister 19 90° and move toward flange 13 when screw 18 is tightened.

Returning to FIG. 1, in remodel applications a hole is cut in the ceiling or wall that is slightly larger than canister 1. Support hanger supports 23 are removed from canister 1. Support hanger support 23 is squeezed firmly at the top and bottom sides at both ends the attachment tabs 24 and 26 slip in or out of the slots provided in support hanger support 23 allowing easy removal or instillation. Canister 1 and associated parts are then inserted through the hole until flange 13 contacts the lower surface of the ceiling. Self taping screws 18 are tightened causing retainer tabs 19 to rotate 90° and move toward flange 13. This continues until retainer tabs 19 contact the upper surface of the ceiling. The supply line is then connected to the power and instillation is complete.

Figure 2:
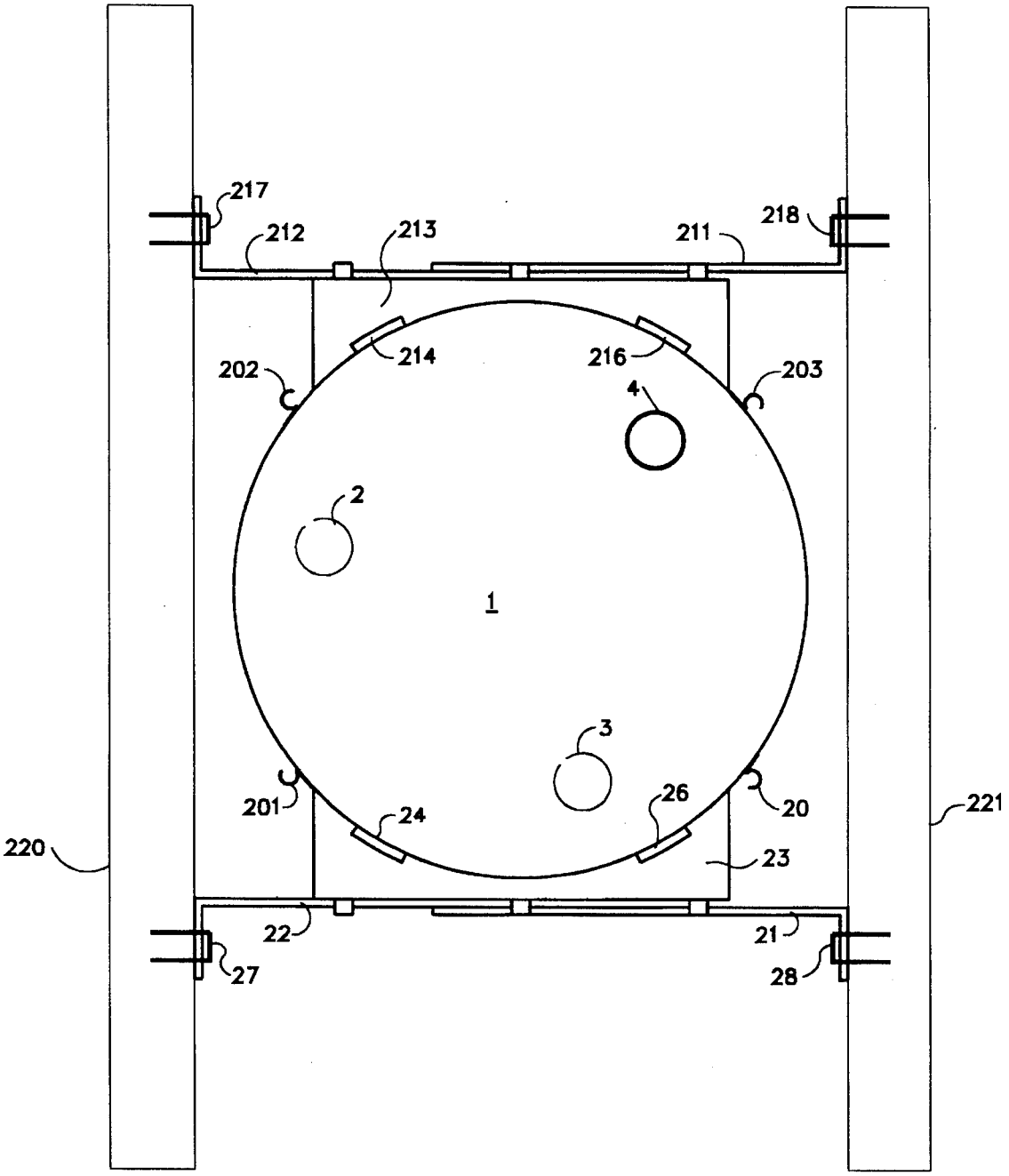
FIG. 2 is a top plan view of the FIG. 1 embodiment.

FIG. 2 is a top plan view of the FIG. 1 embodiment, parts already described in FIG. 1 are given the same number in this figure. All components are connected to canister 1. Three knock out holes 2–4 are on the top of canister 1. Four screw retainer tab stop assemblies 20, 201–203 are attached to the bottom of canister 1 and consist of the components in the description of FIG. 1A. Two support hanger supports 23 and 213 are attached to the side of canister 1. Two support hangers 21,22 are slidably attached to a support hanger support 23 and provided with connection means 27, 28 such as a nail or staple. Support hanger support 23 is in turn attached to canister 1 by means of two attachment tabs 24, 26. Attachment tabs 24, 26 are attached to canister 1 by means of spot welds and constructed of the same material as canister 1. Two support hangers 211,212 are slidably attached to a support hanger support 213 and provided with connection means 217, 218 such as a nail or staple. Support hanger support 213 is in turn attached to canister 1 by means of two attachment tabs 214, 216. Attachment tabs 214, 216 are attached to canister 1 by means of spot welds and constructed of the same material as canister 1. Two slotted attachment plates 215, 220 are attached to the interior of canister 1 to receive springs.

To install canister 1 and associated components in new construction canister 1 is positioned with support hangers 23 and 213 attached. Support hangers 21,22,211 and 212 are then extended until they are in contact with the nearest building support members in this case rafters 220 and 221. Support hangers 21,22,211 and 212 slides through support hanger supports 23 and 313. Staples 27,28,217 and 218 are then attached to rafters 220 and 221. The electrical connectors are then attached as in remodel applications.

Figure 3:
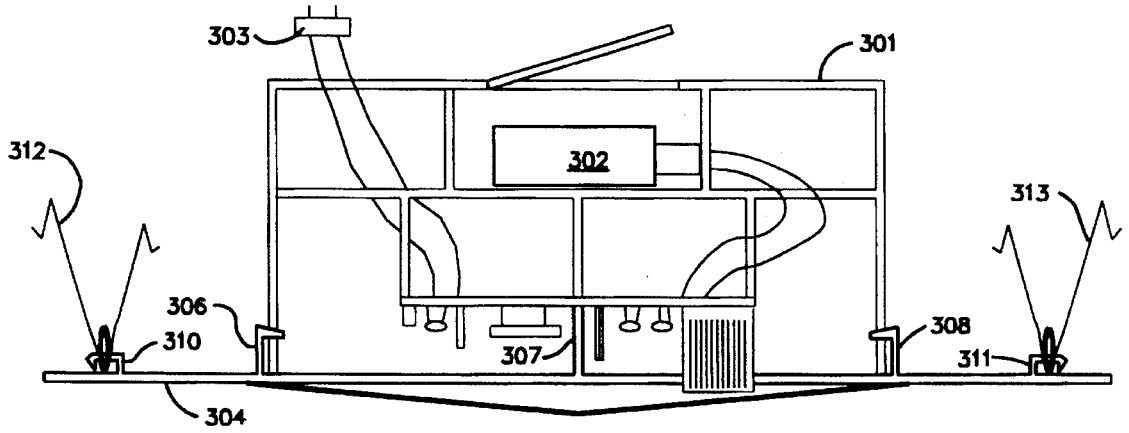
FIG. 3 is a front perspective view of the detector trim ring assembly of the invention.

FIG. 3 is a front perspective view of the detector trim ring assembly of the invention which is identical in either remodel or new construction applications. Detector 301 is a dual power detector which includes both a battery 302 and a 110 volt supply connection. A suitable detector usable in this invention is a FireX Model FX1218. The 110 volt connection is made by a male quick connector 303. Detector 301 is attached to a trim ring 304 by a plurality of attachment clips 306,307 and 308 another clip is present behind detector 301. Trim Ring 304 is both a trim ring and grill and may be molded in different colors. Trim ring 304 is the only portion visible from the interior of the room. Attachment clips 306–308 are molded into trim ring 304 and match slots present in detector 301. A plurality of spring mounting brackets 310 and 311 are also molded into trim ring 304. Spring mounting brackets 310 and 311 are adapted to receive retainer springs 312 and 313. Retainer springs 312 and 313 are coil springs with extended ends.

When inserted into canister 1 ends of spring 312 and 313 are pressed against the interior of the canister by spring tension to retain the detector in the canister. To assemble the invention first male quick connector 303 is inserted into the female quick connector 11 in canister 1, springs 312 and 313 are compressed and inserted into canister 1 and trim ring 304 is pressed toward flange 13 until trim ring contacts either flange 13 or the ceiling. To disassemble the invention trim ring 304 is pulled away from the ceiling until springs 312 and 313 pop out of the spring retainers in canister 1. The power is disconnected at quick connector 303 allowing one to change battery 302 or servicing.

Figure 4:
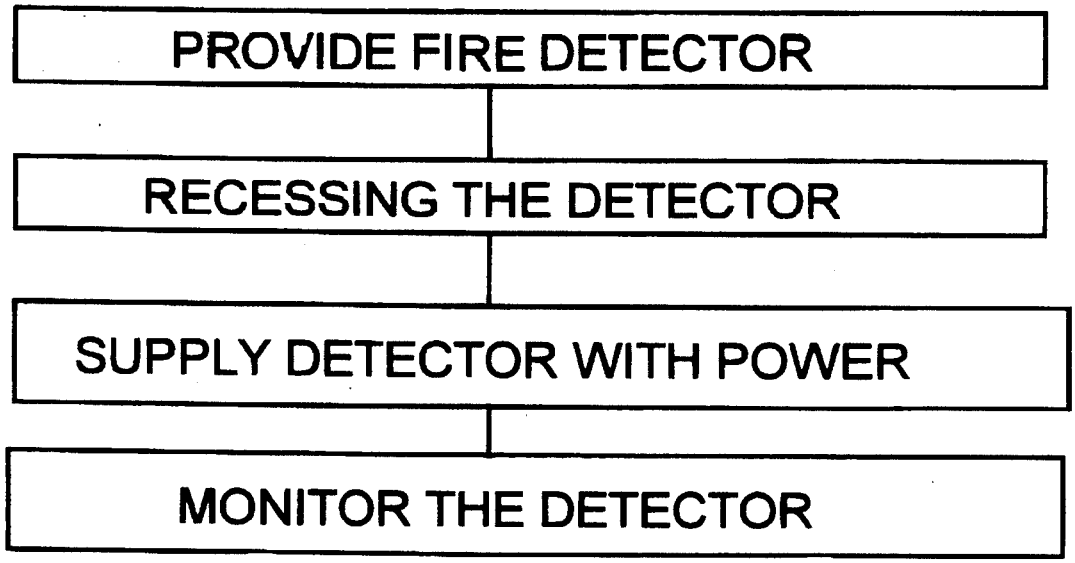
FIG. 4 is a flow chart of the method of the invention.

FIG. 4 is a flow chart of the method of the invention. Performance of this method requires the use of building having at least on ceiling. The first step is providing a fire detector for detecting temperature or combustion products. The second step is recessing the detector into the ceiling or upper wall of a structure. The third step is supplying power to the recessed detector. The final step is monitoring the detector.

The above descriptions of embodiments are exemplary only the invention being defined solely by the attached claims.

I claim:

1. An apparatus for detecting fire in a structure having walls and a ceiling wherein said ceiling is a flat surface supported by a plurality of rafters, comprising: a detector for sensing the presence of combustion products including hot fluids, and mounting means including a metallic canister with a flange on one end and a top at the other, and a trim ring and grill means attached to said detector, said trim ring and grill means including spring mounts for attachment of retainer springs for frictionally fitting against the interior wall of the canister for removably retaining said detector in said canister by spring action.

2. An apparatus as in claim 1, wherein said mounting means includes a plurality of mounts adapted for attachment to an existing flat surface.

3. An apparatus as in claim 2, wherein each of said mounts further comprises a screw, and a screw retainer attached to said canister and adapted to receive said screw and a tab stop attached to said screw and said screw retainer in such a manner as to move toward said flange and outward from said canister when said screw is tightened.

4. An apparatus as in claim 3, wherein said mounting means further includes means for attachment to building support members such as rafters.

5. An apparatus as in claim 4, wherein said mounting means includes a detachable support attached to said canister and extendible support members slidably attached to said detachable support member and adapted for attachment to said building support members.

6. An apparatus as in claim 1, wherein said trim ring is attached to said detector by a plurality of attachment clips integrally molded to said trim ring.

7. An apparatus as in claim as in claim 6, wherein said detector is further connected to a male quick connector.

8. An apparatus as in claim 1, wherein said detector is a dual power detector adapted for connection to 110 volt power and battery power.

9. An apparatus as in claim 1, wherein said attachment means includes a detachable support attached to said canister and extendible support members slidably attached to said detachable support member and adapted for attachment to said building support members.

10. An apparatus as in claim 1, wherein said mounting means is adapted for mounting to both an existing structure and to new structure under construction.

11. An apparatus for detecting fire in a structure having walls and ceiling wherein said ceiling, is a flat surface supported by a plurality of rafters, comprising: a dual power detector adapted for connection to 110 volt power and battery power for sensing the presence of combustion products including hot fluids, a cylindrical metallic canister for housing said detector and includes a flange on one end and a top at the other, and mounting means attached to said canister adapted for mounting said detector into the walls and ceiling of said structure and in such a manner as not to protrude into the interior spaces of said structure and adapted for mounting to both an existing structure and to new structure under construction, said mounting means further comprising first mounting means including a detachable support member attached to said canister and extendible support members slidably attached to said detachable support member and adapted for attachment to said rafters, and second mounting means including a screw, and a screw retainer attached to said canister and adapted to receive said screw, and a tab stop attached to said screw and said screw retainer in such a manner as to move toward said flange and outward from said canister when said screw is tightened, and a trim ring and grill means attached to said detector by a plurality of attachment clips, said trim ring and grill means including spring mounts for attachment of retainer springs for frictionally fitting against the interior wall of said canister for removably retaining said detector in said canister by spring action.

* * * * *